US007344377B2

(12) United States Patent
Bozicevic

(10) Patent No.: US 7,344,377 B2
(45) Date of Patent: Mar. 18, 2008

(54) SYSTEM AND DEVICE FOR IMPROVING THE PERFORMANCE OF A WATER SKIER IN A SLALOM COURSE

(76) Inventor: Mark Bozicevic, 8814 Wendy La. South, West Palm Beach, FL (US) 33414

( * ) Notice: Subject to any disclaimer, the term of this patent is extended or adjusted under 35 U.S.C. 154(b) by 140 days.

(21) Appl. No.: 11/061,757

(22) Filed: Feb. 17, 2005

(65) Prior Publication Data

US 2005/0191916 A1 Sep. 1, 2005

Related U.S. Application Data

(60) Provisional application No. 60/549,192, filed on Mar. 1, 2004.

(51) Int. Cl.
*A69B 69/18* (2006.01)

(52) U.S. Cl. ..... 434/253; 482/51; 114/68; 114/114

(58) Field of Classification Search ..... 434/247, 434/253; 482/51, 71; 114/68, 69, 114, 123
See application file for complete search history.

(56) References Cited

U.S. PATENT DOCUMENTS 4,287,624 A * 9/1981 Lowther ..... 114/343
5,276,660 A * 1/1994 Lee ..... 368/10
5,551,901 A * 9/1996 Jaeger ..... 441/6
5,934,217 A * 8/1999 Allsop ..... 114/242
6,456,910 B1 * 9/2002 Roe ..... 701/23

OTHER PUBLICATIONS

Ben Favret and David Benzel, "Complete Guide to Water Skiing" p. 89, 1997.*

* cited by examiner

*Primary Examiner*—Kien Nguyen
(74) *Attorney, Agent, or Firm*—Karl Bozicevic; Bozicevic, Field & Francis LLP

(57) ABSTRACT

A method, a system and a device used within such enhances the repeatability and overall performance of a person skiing through a water ski slalom course. The device is a series of markers positioned on the side of a ski boat which markings can be readily viewed by a skier being towed by the boat at a distance of up to about 100 feet. The method comprises having the skier noting the boat markings which the ski rope crosses as the skier begins a turn into the slalom course. Once a run of desired performance is obtained the skier can repeat that performance more readily by always beginning the initial turn into the slalom course based on the ski rope crossing the same marking on the boat.

6 Claims, 7 Drawing Sheets

Putting the square to use for buoys #1 and #6

| | Metric | | | | English | | | |
|---|---|---|---|---|---|---|---|---|
| Dim | Actual | Minimum | Maximum | Actual | Minimum | Minimum | Maximum | Maximum |
| OA | 259m | 258.353m | 259.648m | 849' | 8 7/8" | 847' | 7 7/8" | 851' | 10 3/8" |
| A | 27m | 26.865m | 27.135m | 88' | 7" | 88' | 1 5/8" | 89' | 1/4" |
| B | 41m | 40.795m | 41.205m | 134' | 6 1/8" | 133' | 10 1/8" | 135' | 2 1/4" |
| C | 29.347m | 29.2m | 29.494m | 96' | 3 3/8" | 95' | 9 5/8" | 96' | 9 1/8" |
| D | 47.001m | 46.776m | 47.246m | 154' | 2 3/4" | 153' | 5 3/8" | 155' | 1/8" |
| E | 1.25m | 1.188m | 1.313m | 4' | 1 1/4" | 3' | 10 3/4" | 4' | 3 3/4" |
| F | 11.5m | 11.385m | 11.616m | 37' | 8 3/4" | 37' | 4 1/4" | 38' | 1 3/8" |
| G | 1.15m | 1.035m | 1.265m | 3' | 9 1/4" | 3' | 4 3/4" | 4' | 1 3/4" |
| H | 55 m | 54.725m | 55.275m | 180' | 5 3/8" | 179' | 6 1/2" | 181' | 4 1/4" |

Tolerances (±)

1/4" % on 259 m 5% on E

SYSTEM AND DEVICE FOR IMPROVING THE PERFORMANCE OF A WATER SKIER IN A SLALOM COURSE

CROSS-REFERENCE

This application claims the benefit of U.S. Provisional Application No. 60/549,192, filed Mar. 1, 2004, which application is incorporated herein by reference.

FIELD OF THE INVENTION

This invention relates generally to the field of sports devices and training methods used to enhance performance and more specifically to a method, system and device useful in enhancing the consistency and performance of a water skier moving through a water ski slalom course.

BACKGROUND OF THE INVENTION

Water skiing came about on Jun. 28, 1922 when Ralph Samuelson, an eighteen-year-old from Minnesota, proposed the idea that if you could ski on snow, then you could ski on water. Ralph Samuelson first attempted water skiing on Lake Pepin in Lake City, Minn., towed by his brother Ben. The brothers experimented for several days until Jul. 2, 1922 when Ralph discovered that leaning backwards with ski tips up lead to successful water skiing.

As for proper water skiing equipment, for his first skis Ralph Samuelson tried barrel staves, then snow skis, and finally Ralph fashioned the first dedicated water skis from lumber he purchased and shaped. Samuelson made his bindings from leather strips and used a long window sash as a ski rope.

On Jul. 8, 1925 during an exhibition on Lake Pepin, Ralph Samuelson made the first water ski jump using a greased 4'×16' ramp.

Also in the year 1925, Fred Waller patented the first water skis, called Dolphin Akwa-Skees. Ralph Samuelson never patented his invention. In 1940, Jack Andresen invented the first trick ski, a shorter, finless water ski.

Some dates of note in the sport of water skiing are as follows:

1922: Ralph Samuelson designed the first water skis from two pine boards and successfully skied on Lake Pepin in Lake City, Minn.

1925: Samuelson made the first water ski jumps off a makeshift ramp.

Fred Waller patented the first water skis, the "Dolphin Akwa-Skees."

1928: Don Ibsen develops his own water skis on the West Coast, never having hears of Samuelson or Waller.

1932: The first ski shows are held at the Century of Progress in Chicago and the Atlantic City Steel Pier.

1939: American Water Ski Association (AWSA) was organized by Dan B. Hains. The first National Water Ski Championships are held on Long Island.

1942: Cypress Gardens' first water ski show is organized by Julie Pope.

1947: A. G. Hancock and Dick Pope, Jr., became the first barefoot water skiers respectively.

Chuck Sligh set the first water ski jump record of 49 feet at the Dixie Water Ski Tournament at Cypress Gardens.

1949: First World Water Ski Championships held in France. Willa Worthington and Dick Pope, Jr., represent the U.S. and Worthington wins slalom, jump and overall titles.

Martin meters for measuring jump distances are introduced.

1951: Inaugural issue of Water Skier magazine, published by AWSA.

1954: Warren Witherell sets the first jump record over 100 feet, with the introduction of the first double wake cut. Dick Binette and Butch Rosenburg then jump 102 and 103 feet at the same competition in Laconia, N.H.

1957: The Johnson jump metering system of triangulation was adopted by AWSA.

1959: First Masters Water Ski Tournament held at Callaway Gardens, Ga.

AWSA hired its first paid executive director, William D. Clifford, and opened national headquarters in Winter Haven, Fla.

1960: Penny Baker tops 150 feet in Men's jump at the Lone Star Championships.

1962: Network television broadcast the National Water Ski Championships for the first time at Callaway Gardens.

1964: Barbara Cooper Clack became the first female water skier to top the 100-foot mark in jumping at the Florida State Open.

1968: The American Water Ski Educational Foundation (AWSEF) was chartered to fund the U.S. Water Ski Team, to plan and administer a Water Ski Museum/Hall of Fame and encourage educational opportunities for young skiers.

1969: AWSA writes the rules to sanction Water Ski Racing events. First official AWSA-sanctioned ski race is held in Lakeland, Fla.

1970: First AWSA-affiliated National Speedboat and Water Ski Association (Ski Racing) Nationals are held.

1972: Water skiing was an exhibition sport at the Olympic Games in Keil, West Germany.

1975: First Barefoot Nationals held in Waco, Tex.

First Barefoot World Championships held in Can berra, Australia.

1979: The first National Intercollegiate Water Ski Championships were held in Monroe, La., with Northeast Louisiana University winning.

1980: Bob LaPoint became the first skier to make a perfect pass on an 11.25-meter line (38 feet off) in a Record Capability tournament at the McCormick World Record Challenge in Seffner, Fla.

Water Ski Museum/Hall of Fame established by AWSEF in Winter Haven, Fla.

1982: Cory Pickos broke the 9,000-point mark in the International Orange Free State Tournament, a feat he later duplicated at the McCormick International Cup.

1984: The Coors Light Water Ski Tour, only standardized series of Pro water skiing in the world, began.

1986: The U.S. Barefoot Team won its first team title at the Barefoot Worlds in Kelheim, Germany. Previously, the Australians had dominated the World Tournament.

1987: First Kneeboard Nationals are held in Texas.

1988: Sammy Duvall set the distance jump record for Open Men by soaring 205 feet in Shreveport, La.

Deena Brush Mapple set the Open Women's World jump record of 156 feet on a five-foot ramp. (Not challenged until 1996).

1989: Andy Mapple of Great Britain set the Open Men's slalom record of 3 @ 41 off.

The U.S. Water Ski Team won its 21st consecutive World Championship Team title in West Palm Beach, Fla.

1990: Mike Kjellander of Sweden and Sherri Slone take the overall titles in the inaugural season of the Michelob Dry Water Ski Tour.

1991: The U.S. Water Ski Team placed second in the World Championships, held in Villach, Austria.

1992: The U.S. Barefoot Team won its fourth straight World Championship in England.

1993: Sammy Duvall set the Open Men's world jump record of 220 feet at the International Cup in Santa Rosa Beach, Fla.

1994: Wakeboard was introduced to TV by ESPN. Also was the first year wakeboarding was a competitive event at the Masters.

1995: The U.S. Water Ski Team took the silver medal for the third consecutive year at the Worlds in France.

Water skiing competed in its first Pan American Games, held in Santa Fe, Argentina. The U.S. Team won 4 gold, 2 silver and 1 bronze medal, as well as the silver for the team overall. Canada placed first in team competition.

1996: The first World University Trophy was held in Milledgeville, Ga.

AWSEF purchased property along Interstate 4 between Tampa and Orlando, Fla., for a new Hall of Fame facility.

Mario Moser of Germany sets the new Men's World Barefoot jump record of 92 feet (28.10 meters).

Emma Sheers of Australia breaks Deena Mapple's long-held Open Women jump record with a 158-foot leap (48.2 meters).

1997: U.S. Olympic Committee recognizes water skiing as a Pan American Sports Organization and AWSA as the official National Governing Body.

AWSEF/AWSA launch a fund-raising campaign to build the new Hall of Fame and administrative offices on I-4.

Brenda Baldwin sets new World Record in Women's jumping of 166 feet (5-½-foot ramp).

Summarizing, Ralph Samuelson (1922) tried skiing over water first on barrel staves and then on snow skis. He finally found success on pine boards 2.5 meters (8 feet) long and 23 centimeters (9 inches) wide. Water-skiing really picked up speed after World War II, when affordable, high-horsepower outboard motors meant more people could own the fast boats needed to tow water-skiers.

The physics of water skiing works because pressure on top of the water skis (including the weight of the ski, the person, and the air above both) remains constant, whether the skier is at rest or moving. However, as the skier picks up speed, the water pushes against the bottom of the skis. The larger or longer the ski, or the faster a boat is traveling, the greater the total area and thus total pressure against the bottom of the skis, thus, the easier it is for a skier to stay up on the water. The average speed to keep a 68-kilogram (150-pound) adult afloat on water skis is about 32-40 kilometers per hour (20-25 miles per hour). But for barefooting, where all 68 kilograms of weight are concentrated on the soles of two feet the area is small compared to skis. To increase the total area and such the total pressure to a point sufficient for skiing, a speed of 56 kilometers per hour (35 miles per hour) is necessary.

Different lengths and edges of water skis offer different combinations of speed and control. For instance, a beginning skier would want two longer skis for stability, with flat bottoms for riding high and fast on the wake. A more advanced skier could switch to just one ski, called slaloming, and use a beveled bottom for more controlled turns. And highly experienced skiers may choose a ski with a concave bottom, which holds turns by cupping water underneath.

Some expert skiers even add an underwater rudder with wings set at a particular angle to aid turning. These wings create drag and slow down the ski like a brake, making it easier to turn. Then, when the skier leans back to come out of a turn, the wings become parallel to the flow of water and offer minimal resistance.

Water skiing has been around far longer than many people would think, as stated above the first known record of anyone water skiing was a certain Ralph Samuelson of Lake City, Minn., USA who in 1922 eventually got up on his nine ft jump water skis. Having finally mastered the skis, he went on to build a ramp and became the first known water ski jumper Always looking for new things to achieve with his water skis, he later skied behind a flying boat. By a slow process of trial and error in the period before World War II, skills, techniques and competitive rules were gradually evolved. In the years immediately after the war these were systematized, sanctioned and codified following the formation of the World Water Ski Union in 1946.

Although the sport had long since progressed to free skiing (rope held in the hands) from single aquaplaning, equipment was still heavy and clumsy and boats in these early days were not designed specifically to cater for skiers requirements. It is only comparatively recently, therefore, from the fifties onwards, that the introduction of well designed new equipment and powerful, less expensive boats, has helped water skiing become so enormously popular the world over. The sport has, to some extent been boosted, no doubt, by the gradually increasing amount of leisure time available.

It follows naturally that the sport should have a fascination for families as a whole, for here is the ideal leisure-time activity in which all can participate—as energetically or casually as they feel inclined.

By its very nature, water skiing has flourished more rapidly in those Countries enjoying warm sun and water conditions—Australasian, Continental countries with a Mediterranean coastline and the more southern states in the USA. In countries with less favorable weather and colder water, progress has naturally been slower, but the establishment intensive and constant training, together with the advert of the really effective rubber wet suit, has inspired in recent years, enormous interest and development throughout Northern Europe.

SUMMARY OF THE INVENTION

A device and system which uses the device to enhance the repeatability and quality of a water skier's performance skiing through a water ski slalom course is disclosed here. The device is a component which is comprised of a plurality of indices adhered to one or both sides of a boat at known intervals based on an angle taken by a ski rope from a ski pylon to a skier. By beginning the initial turn into a slalom course as the skier's rope moves over one of the indices the repeatability and quality of the results obtained by the skier in entering the slalom course and then completing the course in an optional manner are improved.

An aspect of the invention is a system comprising a boat with a pylon attached thereto, and a plurality of markings or indices on the side of a boat positioned aft of the pylon wherein the indices are readily viewable by the skier the end of the rope.

Another aspect of the invention is such a system wherein a second plurality of markings are on the opposite side of the boat.

In yet another aspect of the invention the markings are brightly colored stripes which have a color which contrasts with the color of the side of the boat.

Still another aspect of the invention is a method of improving the quality and repeatability of the skier's performance in skiing through a water ski slalom course.

Still yet another aspect of the invention is a strip of waterproof material with an adhesive backing allowing it to be readily adhered to the side of a boat and provide markings for the skier to see.

An aspect of the invention is a method of waterskiing comprising skiing towards a beginning of a slalom course in a normal manner, noting the position of the ski rope relative to at least one marking on the boat and beginning an initial turn towards the entrance gates of the slalom course at a noted position of the rope crossing the marking on the boat.

Yet another aspect of the invention is the method as referred to above carried out repeatedly so that the initial turn toward the entrance gates of the slalom course is consistently made at the same point relative to the rope crossing a marking on the side of the boat wherein that point is associated with the skiers optional performance.

Another aspect of the invention is a water skiing system comprised of a boat, a ski pylon attached to the boat in its center relative to the sides of the boat and a plurality of markings on a first side of the boat positioned aft of the pylon.

Yet another aspect of the invention is a device for improving the repeatability of a water skiers performance comprised of a waterproof sheet of material having thereon a plurality of regularly spaced markings which markings can be seen at a distance of about 75 feet of more by a person with normal vision and a waterproof adhesive backing on the sheet of material which allows the material to be adhered to the side of the boat.

Yet another aspect of the invention is a boat having adhered to its side surface a device such as that described above.

These and other objects, advantages, and features of the invention will become apparent to those persons skilled in the art upon reading the details of the ski system, method and device as more fully described below.

BRIEF DESCRIPTION OF THE DRAWINGS

The invention is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity. Included in the drawings are the following figures.

DETAILED DESCRIPTION OF THE INVENTION

Figure 1:
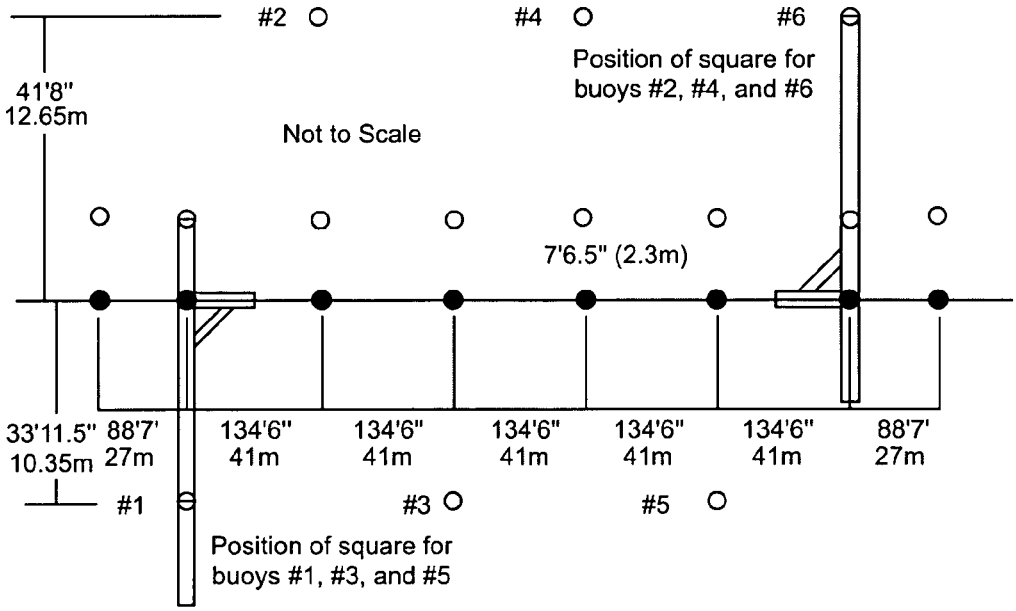
FIG. 1 is a schematic perspective view of a slalom ski course under construction.

Before the present method, system and device for improving slalom water skiing are described, it is to be understood that this invention is not limited to particular embodiment described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described. All publications mentioned herein are incorporated herein by reference to disclose and describe the methods and/or materials in connection with which the publications are cited.

It must be noted that as used herein and in the appended claims, the singular forms "a", "an", and "the" include plural referents unless the context clearly dictates otherwise. Thus, for example, reference to "a mark" includes a plurality of such mark and reference to "the point" includes reference to one or more points and equivalents thereof known to those skilled in the art, and so forth.

The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates which may need to be independently confirmed.

Invention in General

The invention is referred to here as the SmartStart system which is a consistent slalom gate system used to improve the performance of a skier moving through a slalom course for water skiing. In the slalom event the course start or the way the skier enters the course is critical. The boat is moving fast (e.g. from about 25 mph to 36 mph) or (15.5 kph to 58 kph) and as the skier uses shorter rope (e.g. 75 feet to 30 feet) or (23 meters to 9.25 meters) the start becomes even more critical to the skier. The more consistent the skier can be at the start the more consistent the skier can be in the remainder of the course.

Two important factors in getting a consistent start in the water ski slalom course are (1) how wide the skier pulls out to the side of the boat; and (2) how fast the skier is actually going when starting the turn.

Without a point of reference it is difficult to judge where one is and when to begin a turn at the beginning of a slalom course. By using the present invention and marking the side and or the gunnel of the boat in a consistent manner in accordance with the present invention the skier can use the angle of the rope as viewed by the skier and indicated by the marks on the boat. In addition to providing information to the skier on position, the movement of the ski rope over the marking on the boat can also provide the skier with a relative read on skier speed by noting weather the skier is advancing on the boat (moving the rope forward towards the next mark or backward towards the next mark). By using a plurality of marks on the side of the boat facing the skier, with the marks placed consistently at known positions the skier makes use of the system of the present invention in order to consistently obtain the same start—and this can be done on any boat with the marks portioned at the same relative positions.

To establish the marks to be placed on the side of the boat an imaginary line is drawn down the center of the boat from the bow to the stern. Another line is then drawn at 90 degrees to this center line at the center of the ski pylon out to the port or left side of the boat. This spot is marked as the starting point. From this point towards the back of the boat a measurement is made to the beginning of the marking at about 1 to 7 feet or in a range of from 2 to 5 feet or preferably about 40 inches. This measured point acts as the base line for the beginning of the front or bow end of the marks. From this base line a plurality of marks (going toward the back or stern) may be placed at about every 1 to 12 inches, 4 to 8 inches, 3 to 6 inches, e.g. every six inches spacing forward and backward or toward the bow and aft of the boat. The marks are letters in FIGS. 5 and 6.

The marks can take any form including strips, dots, or any symbol, e.g. letters. Preferably the system is used by making a difference in each of the marks (e.g. color, size, brightness or a combination thereof) so the skier can easily see a specific mark and determine a specific reference point on the side of the boat. The marks can be lights, lines, objects, letters or any other indices or component that can be visual perceived by the skier. Marks can also be put on the gunnel of the right side of the boat and/or continuing from the side to the interior portion of the boat so a coach or observer can see the marks and easily determine weather the skier is getting the same angle and or width on each side of the course. By using the marks and establishing the answers to the gate rule questions the skiers starts will be more consistent and slalom scores more consistent as compared to the same skier not using the system.

Gate rules Things the skier needs to know.

The system is best utilized when the skier knows the answers to these questions which allow the skier to ski their best and the skier must be able to consistently duplicate them.

Where are you behind the boat before you pull out?

Some possible choices: Close to the wake? In the trough? Just outside the foam?

When are you going to pull out?

In reference to the Pre-gate buoys

How hard are you going to pull out?

How aggressive? Use a progressive pull?

How wide are you going to pull out?

Wider than the turn balls?

Use the angle of the rope on the side of the boat.

Use SmartStart CSGS (Consistent Slalom Gate System) on the side of the boat.

When are you going to start for the gates?

Where is the boat? Outside the gates? In the gates?

Timing the turn in relation to the pull out?

It is important that the skier be going faster than the boat when beginning a turn for the Gates.

Use the front of your ski. Lead with your ski and knees. Not your upper body.

When you are having trouble skiing and you are only making one or two buoys more than likely you are not performing the correct start.

If you are not skiing at the level you want or you are not progressing and you are consistently doing the same start you need to change what you are doing.

Do not think about what you are doing wrong and try to fix it. Stop, go back to the start and think about and visualize what you do when you are skiing well.

Water Ski Slalom Course

Setting up a water ski slalom course as shown in FIG. 1 requires 22 plastic buoys anchored to the bottom. The following provides information about anchoring them to the proper dimensions with some degree of accuracy.

First, consider where the course will go. You may already have in mind the most sheltered spot on your lake, river or reservoir that is free of backwash and out of heavy boat traffic. You must be aware that the course will require considerably more water surface than just that for the course itself. The course is 850 feet (259 m) long, but you should have a minimum of 600 feet (180 m) of approach space on either end: at the very least, you should be looking at over 2,000 feet (600 m) in length. Also, a regulation course is about 75 feet (23 m) wide, but additional space, perhaps 100 feet (30 m) more to either side, will be needed for safety, for a total minimum width of about 275 feet (85 m). Keep in mind that many states also have a minimum distance from shore within which powerboats can operate only at a no-wake speed. Then be sure that the water is at least five feet (1.5 m) deep in the area during the time the course will be in use.

Before getting too deeply involved in the project, determine what permission you may need from government agencies. Some states' natural resource or environmental departments require that a permit be obtained before a slalom course can be anchored in public waters, and you may need the approval of the town or county in which the site is located. Also, on waters under federal control, you may require the approval of the managing agency such as the Army Corps of Engineers.

In some cases, a public hearing may be required on your request for a permit at which you may encounter resistance from those who oppose water skiing. On waters that are open to powerboating and water skiing, however, the addition of a slalom course should pose no real cause for alarm to anyone.

The buoys are safe and designed not to harm boats or skiers when struck accidentally. Also, despite some contention to the contrary, installing a slalom course does not represent the exclusive use of a portion of the water. Fishermen and other boaters have is much right to that space as the skiers, so common courtesy should dictate how and when the course will be used on a public waterway. If permits or other forms of official permission are required, initiate your request well in advance of the skiing season in case delays are encountered.

Once the coast is clear, you are ready to accumulate the materials that you will need. The best buoys are the official AWSA slalom buoys available through AWSA Headquarters. They are made of heavy tether-type plastic with strong molded attachment rings. The official course contains 22 buoys, generally red-orange for the skier turn buoys and the entrance and exit gates and yellow for the boat guide buoys. For a practice course you may wish to use anti-freeze bottles or other sturdy plastic containers. However, do not attempt to use plastic milk jugs, since they are not durable enough. Most skiers use quarter-inch thick polypropylene ski line for the anchor lines. It does not rot, stretch, or shrink. Be aware that knots in ski line can come untied easily so it is advisable to splice rather than tie the line, especially at the anchor.

The anchoring method used and the amount anchor line and other materials required depend upon the depth of the water and the amount of water level fluctuation expected. With minimal fluctuation, the recommended method is to anchor sub-buoys about three feet below the surface and attach the surface buoys to them with about a foot and a half of some type of elastic.

The elastic keeps the anchor line taut and the buoy directly over the anchor and allows for a 6 to 12 inch (15 to 30 cm) variation in water level. The least expensive elastic that has proven effective is a strip of inner tube. Stout shock cord and latex surgical tubing have also been used successfully. Should a surface buoy come off, you have simply to look for the sub-buoy not far below the surface rather than diving to the bottom to find the anchor. Sub-buoys that are fluorescent orange or white are most easily seen from the surface.

An additional advantage of using sub-buoys is that the surface buoys can be removed during the winter for instance, and then replaced with relative ease. Many skiers have used various sorts of plastic or non-corroding metal clips and hooks to make the job of buoy removal and replacement fast and simple. If you use plastic bottles such as half-gallon milk containers for the sub-buoys, fill them with foam to ensure buoyancy should the containers be punctured.

The most common anchor for slalom buoys is a pair of concrete building blocks. One block may be sufficient on a soft mud bottom. Poured concrete anchors are also commonly used. If fraying of the anchor line where it goes around the anchor could be a problem, use a length of 2 inch (5 cm) garden hose to prevent chafing. For a permanent installation, consider using screw anchors or metal stakes driven into the bottom.

On reservoirs, tidal bays and other waters which experience fairly substantial water level variations, it may be necessary to equip each buoy with a counterweight to keep the anchor line tight. Suitable counterweights can be made from plastic bottles filled with a sufficient amount of sand. Some have used half-pieces of brick, lead sinkers or sash weights. If currents tend to wrap the counter-weight around the main anchor line and prevent it from moving up and down freely U-shaped pieces of plastic or metal tubing can be used to separate the two lines.

A number of methods can be used to fix the location of the buoys. For the ultimate in accuracy, a surveyor with a transit on shore can sight the proper buoy positions while swimmers place the anchors. In northern climes the anchors and sub-buoys can be set in accurately through the ice. Most skiers, however. will want to install their courses with simple tools during the spring or early summer.

A common and relatively easy method of warm weather installation involves the use of a large wooden square. The square can be made of straight 2×4's (5 cm×10 cm—standard size building lumber) bolted together with marks painted at the specified measurements. A rope extension is optional, but it will help in positioning the square when it is in use.

With your square constructed, the next step is to set out a straight line of six boat guide buoys. (Note that the end gates are slightly wider, 2.5 m vs. 2.3 m. You make a line of 8 buoys and adjust the width at the end).

You should have two or three strong swimmers in life jackets and/or wetsuits and one or two helpers in a boat to prepare the anchor-and-buoy rigs, drop them overboard where required, and to help with the visual alignment of the buoys. The swimmers may find that swim fins are very helpful during their time in the water. Make sure you have all of your needed materials and tools in the boat before starting.

Anchor a buoy where you want one end of the course to begin. Next, anchor a temporary buoy approximately where the opposite end of the course will be to help establish a directional line. Working from your first buoy, it is relatively simple to measure the proper distance to the next buoy and to the others in succession by using pre-measured lengths of rope.

By sighting down the row of buoys, a helper in the boat can tell the swimmers how to position the buoys to make a straight line.

Your line of buoys will now serve as a reference line from which the square is used to determine the correct perpendicular distance to the skier buoys and the second line of boat guide buoys. For skier buoys #1, #3 and #5, float the square in the position illustrated in FIG. 1 at the second buoy in your line. Align the short arm of the square with your line of buoys. For greater accuracy in making this alignment, have another swimmer hold the rope extension with a slight tension at the next buoy in your line. When the long arm of the square is perpendicular to the line of buoys, anchor both the skier buoy at the 33' 11½" (10.35 m) mark and the other boat guide buoy at the short end. Repeat this procedure for skier buoys #3 and #5. Visually check your work to make sure that the new buoy lines you have just set out are straight.

Now you are ready to install skier buoys #6, #4 and #2 on the other side of the course as well as the remaining boat guide buoys. Continue to use your original line of eight as your reference line. When the square is in perpendicular position for #6 skier buoy, anchor buoys at the 41' 6" (12.65 m) mark and at the 7' 6½ in (2.3 m) mark. Repeat for #4 and #2. Visually check all four buoy lines of the completed course and reposition any buoys that may be slightly out of line.

Since the distance between the end gate buoys is eight inches wider than that of the course guide buoys, at this point move the end gate buoys out four inches and you have an official course.

Following the technique outlined above, you should have little trouble installing your course in water of reasonable depth. Obviously if the water is very deep, accurately positioning 22 buoys with individual anchors can be very difficult if not impossible. Also, if you would like to move the course to a different location or if you must put in a course at a site for temporary use, such as at a tournament. you must go through the entire routine again.

Fortunately, the invention of several commercially-available submerged cable slalom courses has largely solved these problems. Essentially these systems consist of a single cable with six rigid boom arms or several parallel cables that are submerged five or six feet under water and anchored by single large anchors on either end. The tension of the anchor lines and the upward buoyancy of the buoys assures a stationary and accurate course. The fact that a cable course can be installed quickly at almost any given site, and just as quickly changed in position or removed altogether, is justification enough for many water ski clubs and individual skiers to invest in the device if their needs call for such flexibility.

Otherwise, for a small expenditure in materials, time and effort, you can make your water skiing the ongoing challenge that is the real fun of the sport.

Detailed Description Referring to Drawings

Figure 2:
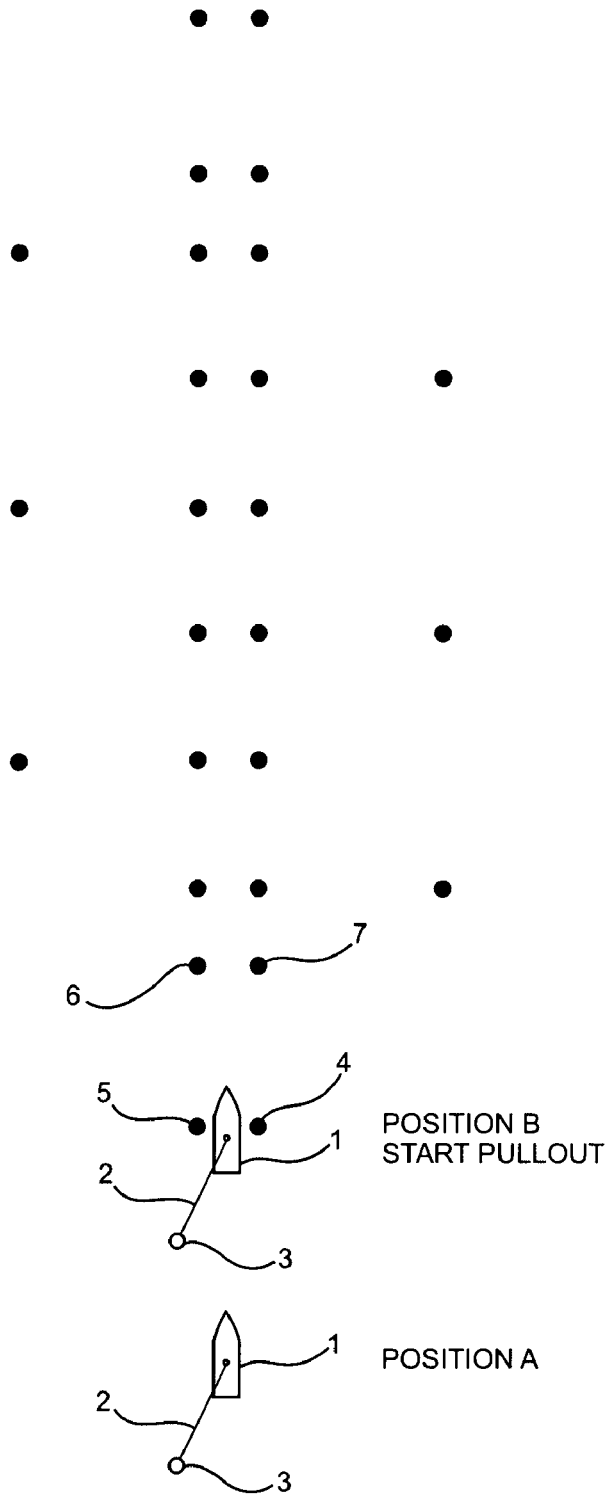
FIG. 2 is a perspective overhead view of a slalom ski course showing a boat in two different possible positions.

FIG. 2 shows a boat 1 connected to a ski line 2 pulling a skier 3. The boat 1 is first shown in position A and then moves to position B between buoys 4 and 5. As the boat approaches the buoys 4 and 5 it gains speed and should be at the maximum speed for the run and the skier 3 holds a handle at the end of the rope or ski line 2 with the skier 3 being positioned to the left of the boat 1 as viewed from the rear. The buoys 4 and 5 are "pre-gates" where the skier 3 begins to pull and move outward further to the left away from the boat 1 and also advancing forward towards the direction the boat is moving in which is between buoys 6 and 7. As the skier 3 pulls progressively harder the skier 3 will advance on the boat 1. While advancing the skier 3 looks at the side of the boat 1 in order to observe markings on the side of the boat.

Figure 3:
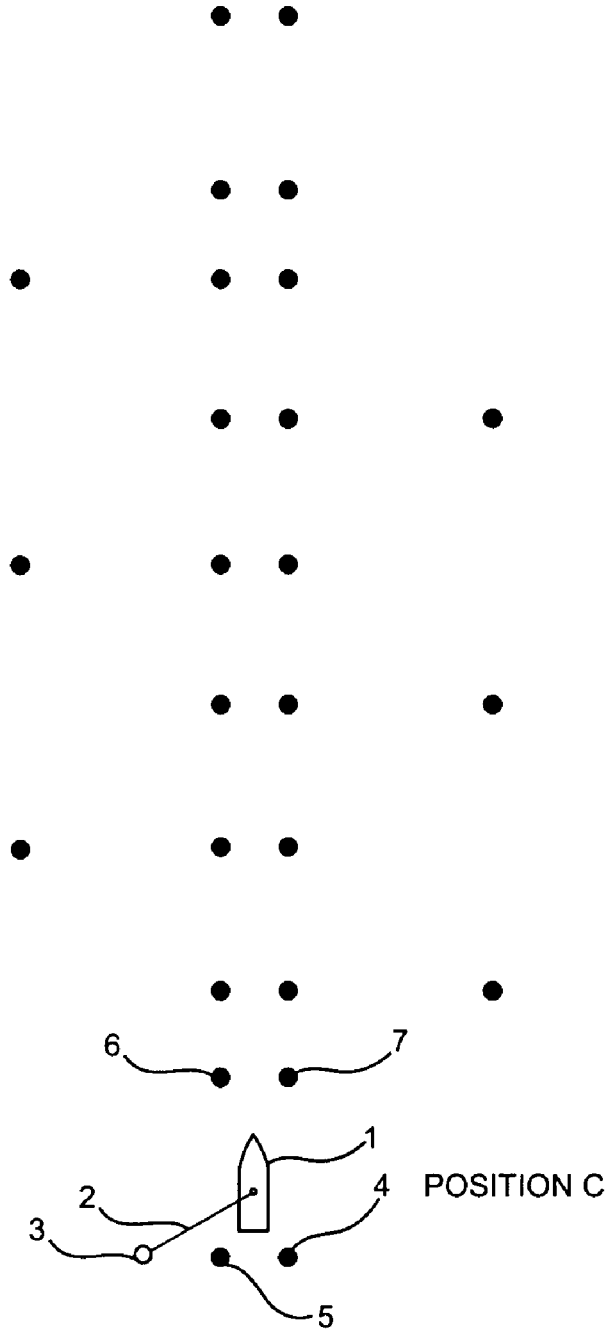
FIG. 3 is a perspective overhead view of a slalom ski course showing the boat moving further down the course compared to FIG. 2.

Referring now to FIG. 3 the boat 1 has moved through the "pre-gate" buoys 4 and 5. The skier 3 is closely observing the markings on the side of the boat 1 which markings can be viewed in FIGS. 5 and 6. The skier specifically focuses on the position of rope 2 and the point at which the rope 2 moves across the marking on the side of the boat 1. At this point the boat 1 is in position C and is about to enter the "entrance gates" marked by buoys 6 and 7. Once the skier 3 has moved to a point so that the rope 2 crosses (is positioned over the mark as viewed by the skier) the desired marking on the side of the boat 1 the skier turns so as to head in a direction towards the boat 1 or more specifically proceeding at an angle toward the entrance gate marked by the buoys 6 and 7. At this point the skier's speed is still greater than the speed of the boat.

By using the marks on the boat 1 the skier can use a slower than conventionally used pull out. By using the marks to establish skier speed relative to the boat and the width on the course it is possible to eliminate the coasting or gliding that is commonly used in starting the course. By eliminating the glide the skier gains more control of when and at what skier speed he will be at when he turns for the gates. With the most commonly used method the skier pulls aggressively to start the pull out and goes into a glide. At this point the skier is going too fast to turn and must wait till he feels like he is going slow enough to turn. Often the skier turns either at too fast or to slow of a skier speed. By using a progressive pull gauging skier speed and width with the marks on the boat the skier can control his speed and at the moment the rope passes the skier's chosen mark he can immediately turn for the gate.

Figure 4:
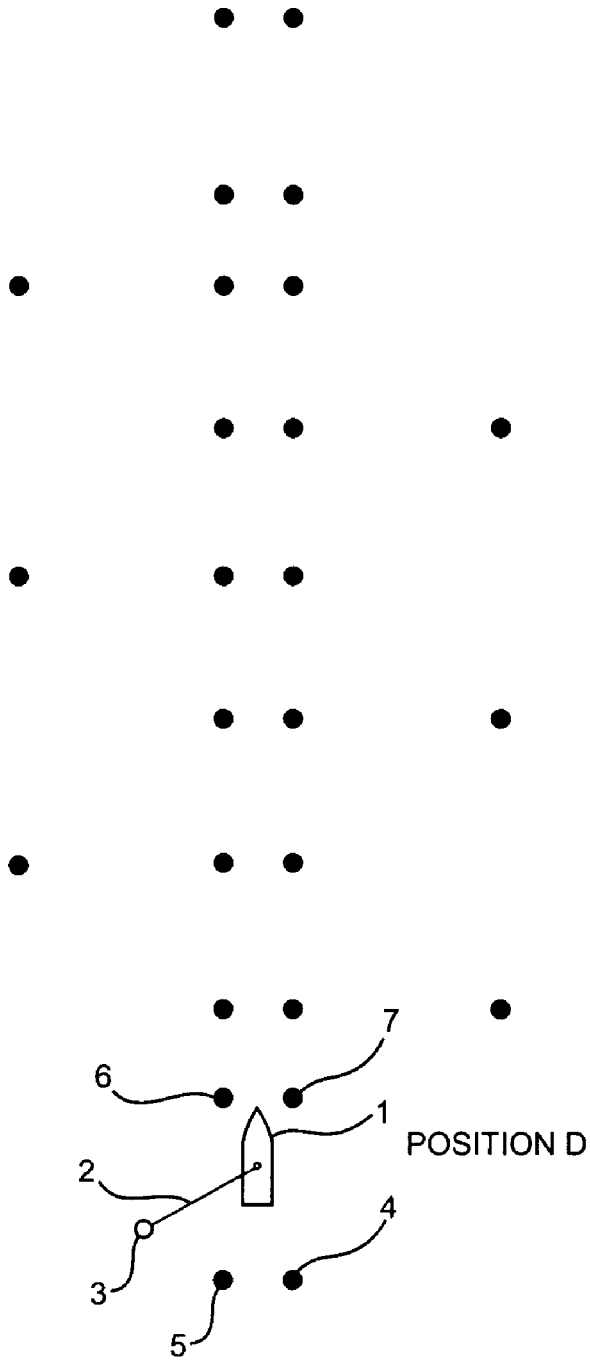
FIG. 4 is another perspective overhead view of a slalom course showing the boat in yet another position.
Figure 7:
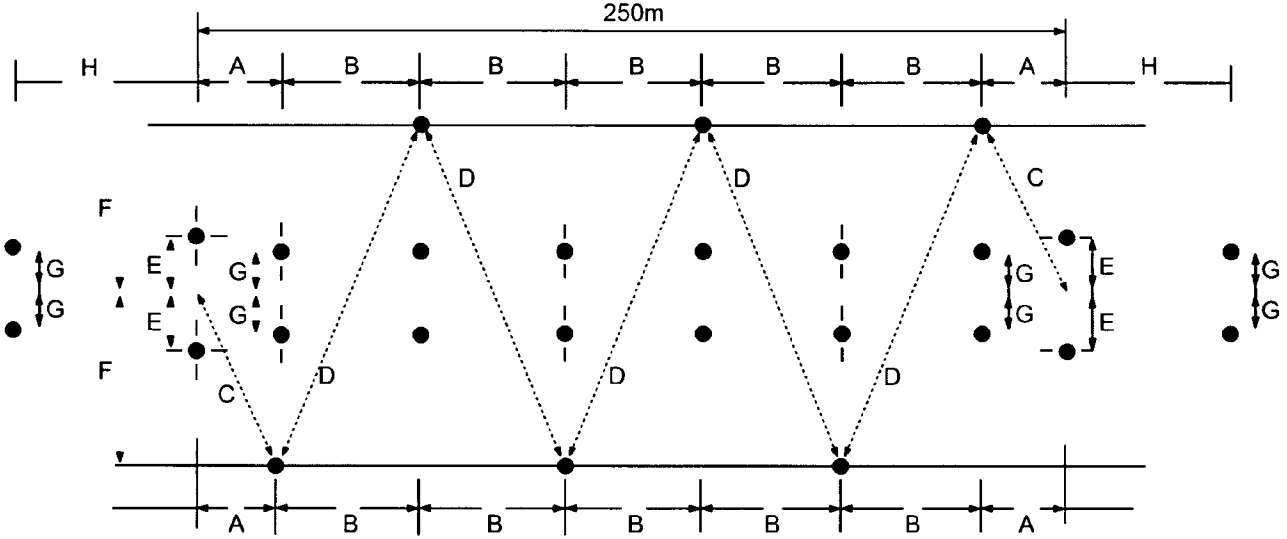
FIG. 7 is a perspective overhead view of an official slalom course showing actual measurements.

The turning point of the skier 3 towards the entrance gate is shown by the position of the skier 3 in FIG. 4. The markings on the boat 1 should be made in the consistent manner and can be duplicated on the other side of the boat and placed on any boat. A more detailed view of an official slalom course is shown in FIG. 7.

Figure 5:
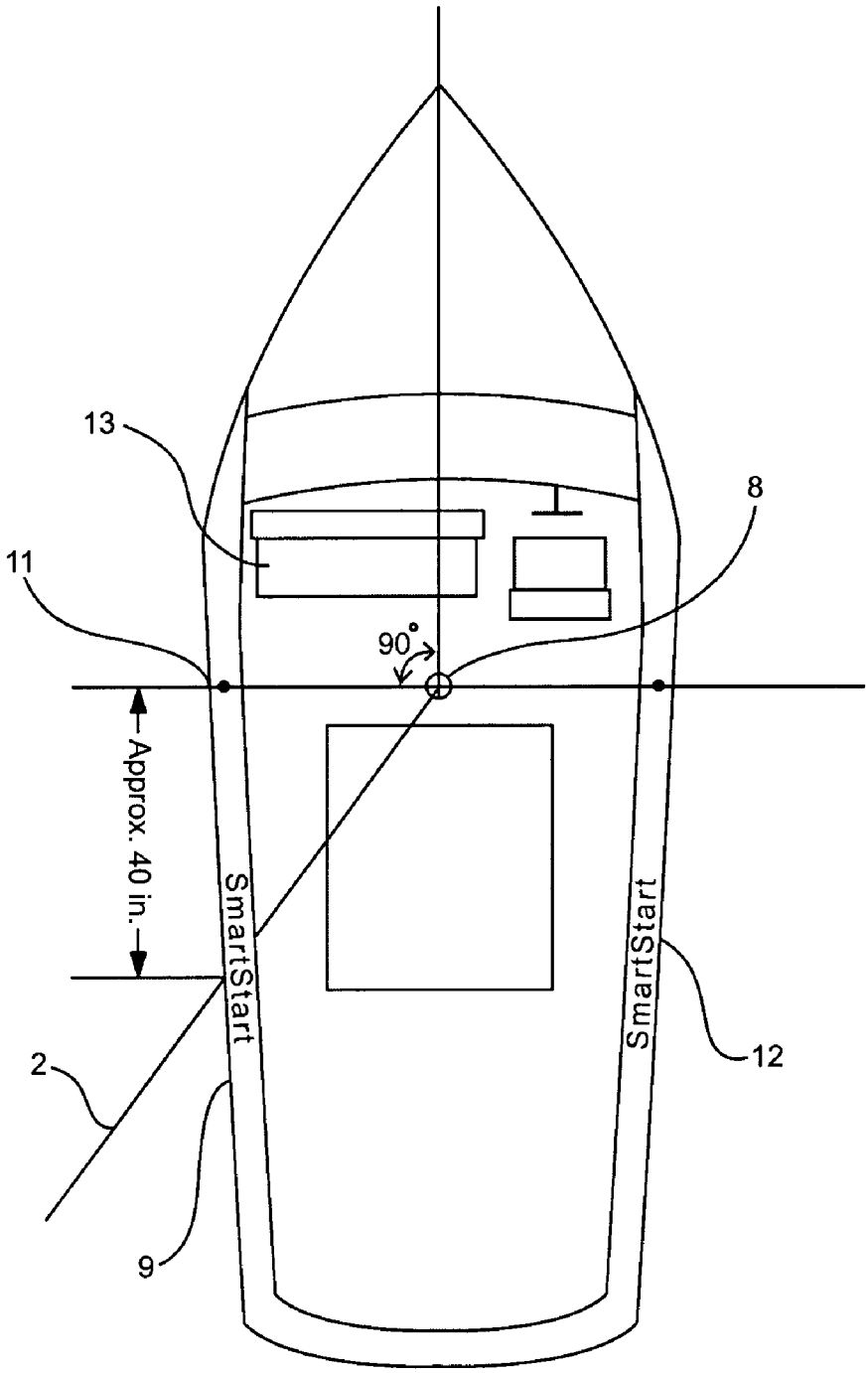
FIG. 5 is an overhead view of a boat.
Figure 6:
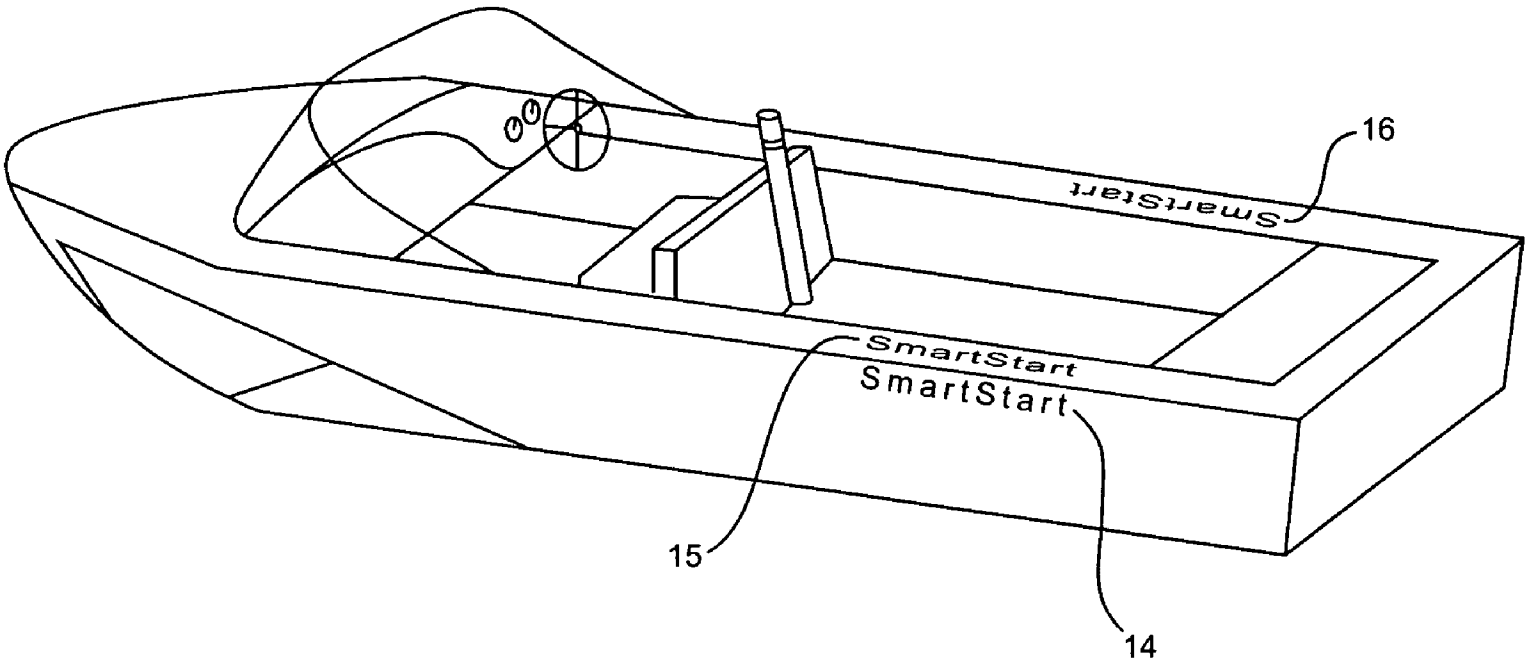
FIG. 6 is a perspective side view of a boat.

FIG. 4 shows the positioning and approximate angle which forms and important part of the present invention. In accordance with the method of the invention the skier 3 is skiing toward a beginning of a slalom course in a normal manner holding a handle attached to the ski rope 2 which is attached to the boat 1. The skier notes his position and more particularly the position of the ski rope 2 relative to at least one marking on the side of the boat 1. The markings are shown in FIGS. 5 and 6. When the rope 2 crosses a particular marking noted by the skier the skier 3 begins an initial turn toward the gates 6 and 7. The skier will note the marking on the side of the boat where the turning towards the entrance gates 6 and 7 was made. If the ski run is successful the skier can repeat this same procedure in order to be consistently successful in making ski runs through the slalom course. If the skier is not successful the skier can choose another marking at which point to begin the turn towards the entrance gates marked by buoys 6 and 7.

A more detailed and overhead view of the boat 1 is shown in FIG. 5. The rope 2 is connected to a pylon 8 which is centered relative to the side of the boat 1. Measuring backward from the pylon 8 (from a point along the side of the boat) approximately 40 inches is the center point for the markings to be placed on the side of the boat. As shown in FIG. 5 the markings can be indicated by the trade name "smartstart". The center of the markings is indicated by the center point 9. At the point 9 the skier 3 begins to move towards the entrance buoys 6 and 7 as shown in FIG. 3.

As shown in FIG. 5 the pylon 8 is positioned in the center of the boat relative to the sides of the boat. If a right angle is made between the pylon 8 and the center of the bow of the boat and a line drawn across the boat the line drawn across the boat will touch the side of the boat at position 11. It is at position 11 backwards that one measures approximately 40 inches in order to determine the center point for the markings on the side of the boat. These measurements are in accordance with size and positioning of conventional ski boats as of the time of the filing of the present application.

As shown in FIG. 5 the boat may include a seat 13 which will allow an observer or coach to observe the skier. Further, the boat may include markings 12 on the opposite side of the boat. These markings can be used for observation by those sitting in the seat 13 or by the skier at other points while the skier moves through the slalom course.

As shown in FIG. 6 it is also possible to include markings 16 inside the boat and markings 15 on the top railing of the boat. This can be of assistance to the coach observing the skier from the seat 13 as shown in FIG. 5. The markings continue backward to a point 14 which may be anywhere from 2 to 4 feet behind the beginning of the markings.

Although the center point 9 (FIG. 5) of the markings should be brightly marked different skiers will need to focus on different points. Accordingly, it is desirable to have a plurality of different markings (regularly spaced) along the side of the boat. Those markings can be positioned at any distance from each other. However, based on the distance the skier is from the boat it has been found desirable to place the markings approximately 4 inches apart from each other.

FIG. 6 shows that the boat 1 can have the markings in the form of letters of the trade name "smartstart" written on the side of the boat. The center point 9 of the "smartstart" markings is preferably the ideal point at which most skiers begin to toward the entrance buoy as the rope moves across that point. However, with some skiers they will focus on different points or different letters in the "smartstart" markings on the side of the boat.

FIG. 7 is included in order to provide more detailed information with respect to the actual measurements of a ski course. Those skilled in the art will recognize that changes may be made over time. However, as of the filing date of the present application these measurements are believed to be substantially accurate with respect to an official slalom ski course. Those skilled in the art will also understand that the ski rope 2 varies in length depending on factors such as the skill of the skier and will further understand that the speed of the boat through the ski course may be varied. Factors such as the length of the ski rope and speed of the boat may affect the point at which the skier begins the turn toward the entrance gate. For this reason the skier may begin the turn as the ski rope crosses a different point depending on the length of the rope and the speed of the ski boat. It is generally desirable to leave the markings in place. However, a particular skier may modify the skiers boat so as to allow the markings to be moveable. Alternatively the markings could be designed so as to allow for two or more skiers to note their exact position at which to turn toward the entrance gate.

The preceding merely illustrates the principles of the invention. It will be appreciated that those skilled in the art will be able to devise various arrangements which, although not explicitly described or shown herein, embody the principles of the invention and are included within its spirit and scope. Furthermore, all examples and conditional language recited herein are principally intended to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary embodiments shown and described herein. Rather, the scope and spirit of present invention is embodied by the appended claims.

That which is claimed is:

1. A method of water skiing, comprising the steps of:

(a) skiing toward a beginning of a slalom course in a normal manner holding a handle attached to a ski rope which is attached to a boat;

(b) noting the position of the ski rope relative to at least one marking on the boat, wherein the noting (b) comprises noting one marking on the side of the boat which one marking is one of a plurality of markings on the side of the boat which markings are placed on the boat for purposes of allowing the skier to note the position of the rope in order to turn towards the entrance gates;

(c) beginning an initial turn toward entrance gates of the slalom course at the noted position.

2. The method of claim 1, further comprising:

(d) repeating the steps (a)-(c) wherein the initial turn toward the gates is begun at some noted position of the ski rope relative to a marking on the boat.

3. The method of claim 1 wherein the noting (b) comprises noting one stripe out of a plurality of substantially vertical stripes on the side of the boat.

4. The method as claimed in claim 1, wherein the noting (b) comprises noting one marking out of a plurality of markings which have a color which contrasts with the side of the boat and each marking is discernable in the noting (b) at a distance of about 75 feet or more by a person with normal vision.

5. The method of claim 4 wherein the noting (b) comprises noting a marking which is one marking out of a plurality of substantially vertical stripes on the side of the boat.

6. The method of claim 4, wherein the noting (b) comprises noting one marking out of a plurality of markings which markings are letters.

* * * * *